US008073096B2

(12) United States Patent
El-Genk et al.

(10) Patent No.: US 8,073,096 B2
(45) Date of Patent: Dec. 6, 2011

(54) METHODS AND APPARATUSES FOR REMOVAL AND TRANSPORT OF THERMAL ENERGY

(75) Inventors: Mohamed S. El-Genk, Albuquerque, NM (US); Jean-Michel Tournier, Rio Rancho, NM (US)

(73) Assignee: STC.UNM, Albuquerque, NM (US)

( * ) Notice: Subject to any disclaimer, the term of this patent is extended or adjusted under 35 U.S.C. 154(b) by 345 days.

(21) Appl. No.: 12/152,386

(22) Filed: May 14, 2008

(65) Prior Publication Data

US 2009/0323886 A1 Dec. 31, 2009

Related U.S. Application Data

(60) Provisional application No. 60/930,059, filed on May 14, 2007.

(51) Int. Cl.
*F01K 3/18* (2006.01)

(52) U.S. Cl. ..... 376/317; 376/383; 376/402; 376/367

(58) Field of Classification Search ..... 376/317, 376/383, 402, 367
See application file for complete search history.

(56) References Cited

U.S. PATENT DOCUMENTS 3,437,847 A * 4/1969 Raspet ..... 310/306
4,315,893 A * 2/1982 McCallister ..... 422/109
4,448,239 A * 5/1984 Edwards ..... 165/47
4,851,183 A * 7/1989 Hampel ..... 376/274
5,078,958 A * 1/1992 Danko et al. ..... 376/272
5,195,575 A * 3/1993 Wylie ..... 165/132
5,219,516 A * 6/1993 Horner-Richardson et al. ..... 376/321
5,684,848 A * 11/1997 Gou et al. ..... 376/367
6,877,318 B2 * 4/2005 Tadayon et al. ..... 60/651
6,889,755 B2 * 5/2005 Zuo et al. ..... 165/104.26
7,067,088 B2 * 6/2006 Le ..... 422/206

FOREIGN PATENT DOCUMENTS

WO WO 03015908 * 2/2003

OTHER PUBLICATIONS

Gauthier et al., "Antares: The HTR/VHTR project at Framatome ANP", Nuclear Engineering and Design 236 (2006) 526-533.*
Kunitomi et al., "JAEA's VHTR for Hydrogen and Electricity Cogenertion: GTHTR300C", Nuclear Engineering and Technology, vol. 39, No. 1, Feb. 2007, pp. 9-20.*
INEEL/EXT-03-00141, Jan. 31, 2003, pp. 1-52.*

* cited by examiner

*Primary Examiner* — Ricardo Palabrica
(74) *Attorney, Agent, or Firm* — MH2 Technology Law Group LLP

(57) ABSTRACT

Methods and apparatuses are provided for the removal and transportation of thermal energy from a heat source to a distant complex for use in thermochemical cycles or other processes. In one embodiment, an apparatus includes a hybrid heat pipes/thermosyphon intermediate heat exchanger (HP-TIHX) system that is divided into three distinct sections, namely: an evaporation chamber, a condensation chamber, and a working fluid transport section of liquid and vapor counter-current flows.

12 Claims, 4 Drawing Sheets

METHODS AND APPARATUSES FOR REMOVAL AND TRANSPORT OF THERMAL ENERGY

CROSS REFERENCE TO RELATED APPLICATIONS

This application claims priority from U.S. Provisional Patent Application Ser. No. 60/930,059, which was filed on May 14, 2007, and which is incorporated by reference herein.

TECHNICAL FIELD

The present invention generally relates to methods and apparatuses for the passive removal and transfer of thermal energy from a heat source to a distant complex where this energy can be used, and more particularly relates to methods and apparatuses for the passive removal and transfer of thermal energy from a Very High Temperature Reactor to a distant hydrogen production complex of a Next Generation Nuclear Plant.

BACKGROUND

Energy is in great demand in today's society. Numerous heat generation sources can be used to harvest thermal energy. This energy may be converted into electricity or stored in a fuel through thermochemical cycles or other processes. For example, thermal energy from a nuclear reactor can be used to generate electricity and hydrogen. Such heat source needs to be distant from the hydrogen production facility for safety reasons. The chemicals used for the production of hydrogen using one of several thermochemical cycles are very corrosive, toxic and may self ignite; let alone the self ignition of the hydrogen should it accidentally mix with air or oxygen above certain concentrations. These concerns justify the need to maintain a large separation distance of tens of meters between the heat source and the hydrogen production complex. The challenge is to reliably transport the thermal energy a long distance, with minimal thermal loss, and at a low cost. Thus there is a need to overcome these and other problems with the prior art to provide methods and apparatuses for the passive removal and transfer of thermal energy from a heat source to a distant complex where this energy can be used.

SUMMARY OF THE INVENTION

Apparatuses are provided for passively removing a large amount of thermal energy from a heat source to a distant complex where this energy can be used. In one embodiment, an apparatus comprises a hybrid heat pipes/thermosyphon intermediate heat exchanger (HPTIHX) that thermally couples the primary coolant loop of a heat source to a complex located at a distance of over 100 meters with no single point failure.

Methods are also provided for passively removing a large amount of thermal energy from a heat source and transporting this thermal energy to a distant complex with minimal energy loss. One of the methods includes the steps of removing thermal energy from a primary coolant loop intermediate heat exchanger and transferring the thermal energy through a multitude of heat pipes into an evaporation chamber that has a shallow pool of working liquid wherein the working liquid is evaporated. This method further comprises transporting the evaporated liquid through a thermally insulated coaxial pipe to a distant, elevated condensation chamber; absorbing the heat through a multitude of inclined heat pipes protruding from an intermediate heat exchanger for use at the distant complex; and passively transferring the condensed working liquid by gravity through the coaxial pipe back into the shallow pool of the evaporating chamber.

DETAILED DESCRIPTION OF THE INVENTION

Figure 1:
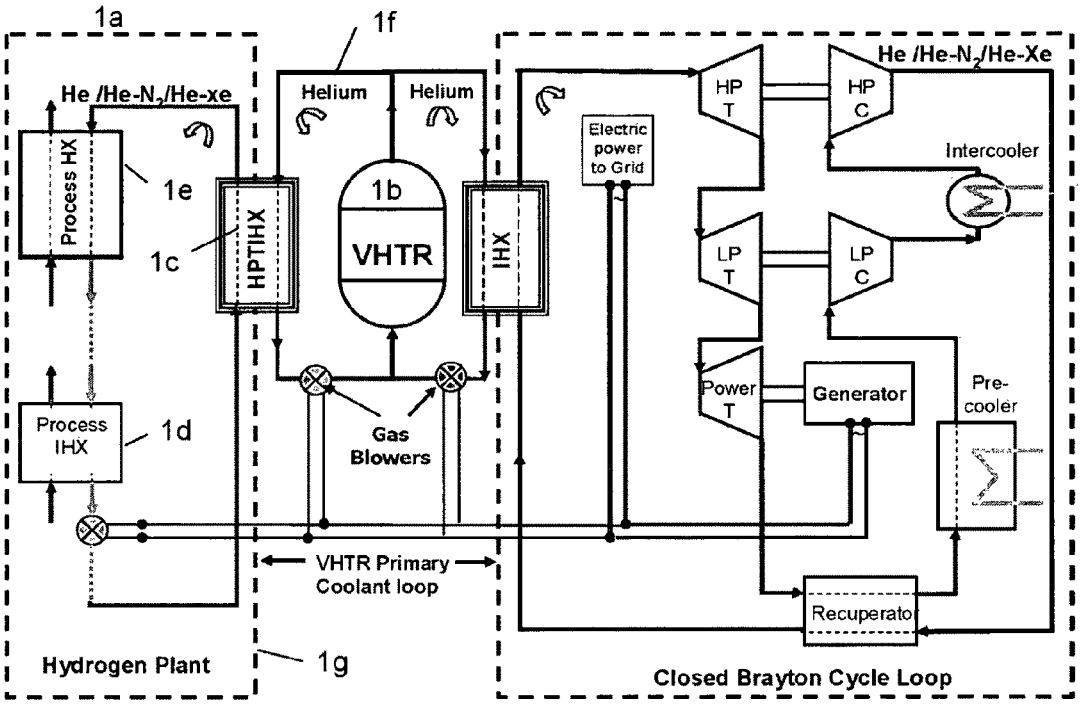
FIG. 1 shows a layout of a VHTR plant for the generation of electricity and co-generation of hydrogen using thermochemical processes or high temperature electrolysis in accordance with the present teachings.

Heat pipes and thermosyphons are passive energy transport devices which do not require any active pumping of their working fluid, and take advantage of the large latent heat of vaporization of their working fluid for removing and transporting the heat at high rates from the heated section and releasing it in the cooled section. The heated and cooled sections of a heat pipe and a thermosyphon could be separated by a long distance, depending on the application and design. While the condensation section of a thermosyphon needs to be elevated relative to the evaporation section, in a heat pipe there is no such restriction. The hydrostatic head between the condensation and evaporation sections of a thermosyphon drives the liquid condensate back to the evaporation section and overcomes the pressure losses in the liquid film flow on the inside of the thermosyphon wall and in the counter current vapor flow from the evaporation to the condensation section. The heat pipes use a thin wick structure on the inside of the enclosure wall which develops a capillary pressure head for circulating the working fluid. Because of this unique feature, unlike thermosyphons, heat pipes can operate in any orientation and at a much higher power throughput.

These passive energy transport devices are light weight because they are only partially loaded with the working fluid of choice (<10% by volume), and the rest of the enclosure volume is filled with the vapor of the working fluid. They are typically designed to nominally operate at ~50% of their highest possible power throughput, and since they are self contained, a failure of a heat pipe does not represent a single point failure. Thus, a heat pipe heat exchanger could continue to operate with multiple heat pipes failures, with no or minimal effect on its operation since the remaining heat pipes will take over the load of the failed ones in their vicinity. The maintenance of a heat pipe heat exchanger is relatively easy, since the failed heat pipes could be replaced with operating ones, and the outer surface of the heat pipes is cleaned easily from any deposits and reaction products with the working fluid during operation.

In a helium cooled, Very High Temperature Reactor (VHTR), the helium coolant enters the VHTR at about 7.0 MPa and 500° C. and exits at 950-1000° C., transporting the fission heat removed from the VHTR core to electricity generation and hydrogen co-production secondary loops. Typically 20% of the reactor thermal power of 600-700 MW is used for hydrogen production using thermochemical cycles or high temperature electrolysis. The coupling of the VHTR primary loop to the hydrogen production complex requires the design of a new type of heat exchanger that provides excellent thermal coupling and at the same time maintains enough separation distance between the reactor complex or primary loop and the hydrogen production plant.

For safety considerations, safe coupling of the VHTR and the hydrogen production complex need to be demonstrated. The hydrogen production complex is thus separated from the VHTR by a distance of 110-140 m. This great distance represents a technological challenge for transporting 10%-20% of the reactor thermal power reliably at average temperature of ~900-950° C. to the hydrogen production complex for 40-60 years. In addition, the coupling heat exchanger of the VHTR primary loop to the working fluid that supplies the heat to the process IHXs in the hydrogen production complex needs to satisfy a number of desirable safety, economical and operation features. These include passive and self-regulating operation, redundancy, reliability, easy and low maintenance, low temperature drop and thermal energy losses, high power throughput, and the capability to physically isolate the VHTR in case of an explosive event in the hydrogen production complex.

The following description is merely exemplary in nature and is not intended to limit the invention or its application or uses. It is not intended to be bound by any expressed or implied theory presented in this disclosure, specifically in the following detailed description.

Referring to FIG. 1, an exemplary Next Generation Nuclear Power Plant la is illustrated where a Very High Temperature Reactor 1*b* (heat source) is helium cooled. A primary working fluid for the process IHXs 1*d*, and 1*e* (second working fluid) in the hydrogen production complex could be He, a binary mixture of He—Xe or He—$N_2$, molten salt, or any other compatible working fluid. A "Hybrid heat pipes/thermosyphon intermediate heat exchanger" (HPTIHX) 1*c* thermally couples the VHTR primary coolant loop 1*f* to the hydrogen production complex 1*g*. The HPTIHX 1*c* satisfies the indicated desirable design, safety and operation requirements of passive and self-regulating operation, redundancy, reliability, easy and low maintenance, low temperature drop and thermal energy losses, high power throughput, and the capability to physically isolate the VHTR in case of an explosive event in the hydrogen production complex.

Figure 2:
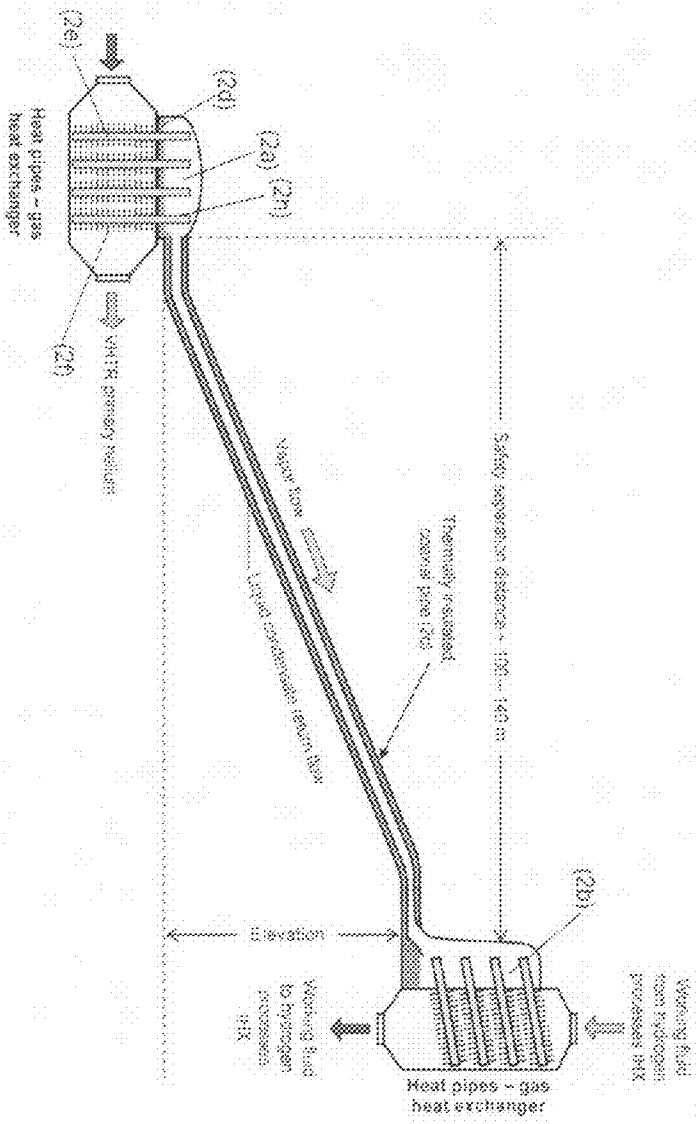
FIG. 2 shows a layout of the hybrid heat pipes/thermosyphon intermediate heat exchanger in accordance with the present teachings.
Figure 3:
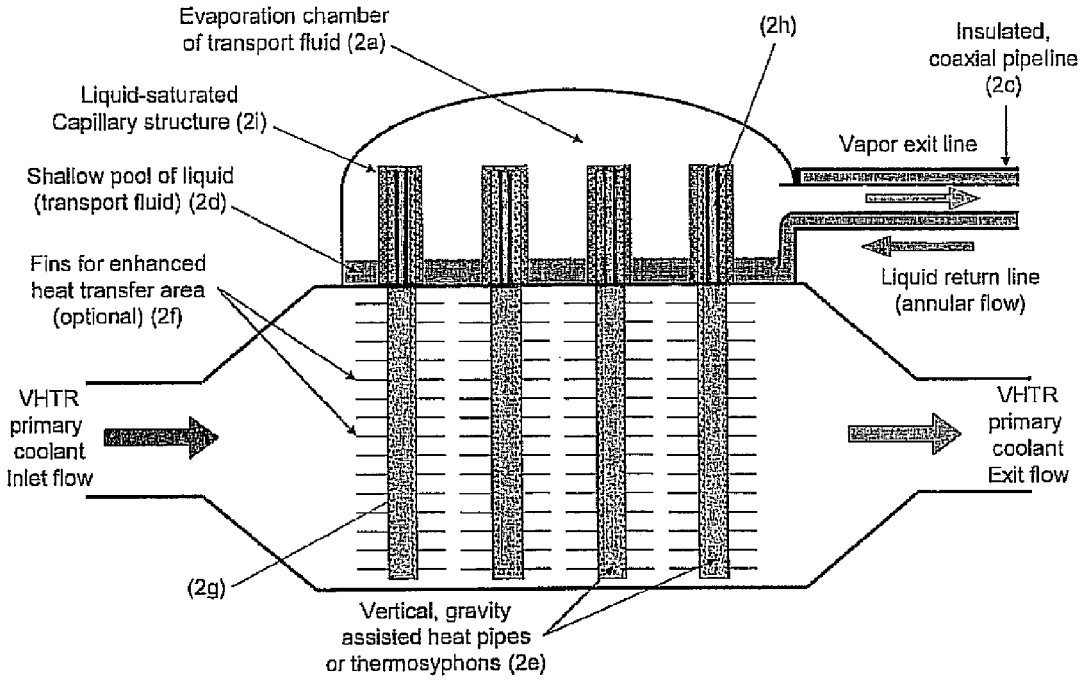
FIG. 3 shows a Line diagram of the liquid metal heat pipes heat exchanger for the evaporation chamber of the HPTIHX in accordance with the present teachings.

Referring to FIGS. 2 and 3, in one exemplary embodiment, the HPTIHX takes advantage of the unique operation characteristics of heat pipes and the thermosyphons. The HPTIHX in FIG. 2 includes an enclosure that is divided into three distinct sections, namely: an evaporation chamber 2*a*, a condensation chamber 2*b* and a working fluid transport section of the liquid and vapor counter-current flows 2*c*. The evaporation chamber of the HPTIHX 2*a* has a shallow pool of a working liquid 2*d* and is protruded at the bottom by a multitude of heat pipes 2*e* with a liquid metal working fluid within. These liquid metal heat pipes are made of cylindrical enclosures with fins 2*f* on their evaporation section 2*g* heated by the VHTR primary helium coolant (FIG. 1). In one embodiment, they are staggered either in a square or triangular grid and remove the heat from the reactor's primary coolant by convection, and transport it to condensation sections 2*h* within the heat pipes that are partially submersed within the liquid pool in the evaporation chamber 2*a* of the HPTIHX. The outer surface of the condensation section 2*h* of the liquid metal heat pipes in the evaporation chamber 2*a* of the HPTIHX has longitudinal grooves to pump the liquid from the shallow pool by capillary action and spread it over the full length of the condenser surface, thus ensuring the continuous wetting of the surface to facilitate evaporation. This surface is also covered with a porous wick 2*i* of fine metal screen or porous ceramic to provide additional capillary head. The vapor flows through a thermally insulated coaxial pipe 2*c* to the condensation chamber 2*b*. Return of the condensate to the evaporation chamber 2*a* of the HPTIHX is aided by gravity since a condensation chamber 2*b* is elevated by several meters relative to the evaporation chamber 2*a* of the HPTIHX (FIG. 2). This elevation head depends on the operation requirements for the HPTIHX and the separation distance of the VHTR primary loop from the hydrogen production complex FIG. 1).

Figure 4:
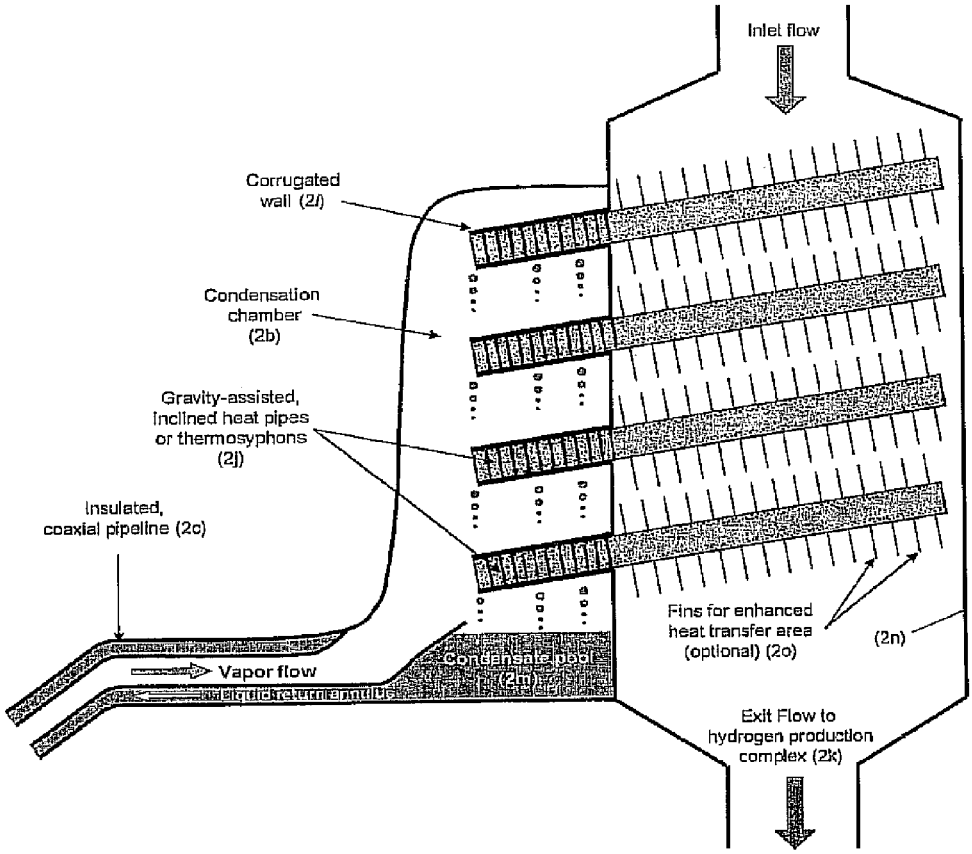
FIG. 4 shows a Line diagram of the liquid metal heat pipes heat exchanger for the condensation chamber of the HPTIHX in accordance with the present teachings.

Referring to FIG. 4, there is a multitude of liquid metal heat pipes 2*j* that protrude the condensation chamber 2*b* of the HPTIHX and remove the heat liberated by the condensation of the liquid working fluid of the HPTIHX to the working fluid of these liquid metal heat pipes 2*j*, and in turn to the working fluid 2*k* for the processes IHX 1*e* in the hydrogen production complex (FIG. 1). The evaporation section of the heat pipes in the condensation chamber 2*b* of the HPTIHX has a corrugated surface 2*l* for increasing the condensation surface area and reducing the thickness of the condensate on the surface, thus increasing the condensation heat transfer coefficient and facilitating the drainage of the condensate liquid into the shallow pool 2*m* at the bottom of the condensation chamber 2*b* of the HPTIHX. The condensation section of the heat pipes that protrudes the wall of the evaporation chamber 2*b* into the heat exchanger 2*n* of the working fluid of the hydrogen processes IHXs 1*e* and 1*d* (FIG. 1) has metal fins 2*o* to increase the heat transfer area. The condenser section of these liquid metal heat pipes 2*j* is elevated slightly (10-20°) relative to the horizontal (inclined). Such an inclination angle will provide additional driving pressure head for circulating the working fluid in the liquid metal heat pipes 2*j* in the condensation cavity 2*b* of the HPTIHX. In addition it will enhance the drainage of the liquid condensate from the outer surface of the evaporation section 2*l*.

The type of the working fluid for the liquid metal heat pipes 2*e* and 2*j* in the VHTR primary loop heat exchanger and the heat exchanger to the working fluid of the processes heat exchangers in the hydrogen production plant (2*j*) and the working fluid in the HPTIHX depends on the operation temperatures and the vapor pressures of the working fluids. For example for temperatures below 200° C., water is an appropriate working fluid, potassium at 350-700° C., and sodium at 600-1000° C., and lithium above 1000° C., etc. For the VHTR application, the working fluid for the HPTIHX could be sodium, and for the liquid metal heat pipes 2*e* and 2*j* the working fluid could be potassium.

While at least one exemplary embodiment has been presented in the foregoing detailed description, it should be appreciated that a vast number of variations exist. Other embodiments of the invention will be apparent to those skilled in the art from consideration of the specification and practice of the invention disclosed herein. It is intended that the specification and examples be considered as exemplary only.

What is claimed is:

1. A nuclear power plant comprising:

a Very High Temperature Reactor (VHTR);

a hydrogen production facility spaced from the VHTR by a distance of about 100 m to about 140 m; and an intermediate heat exchanger (IHE) interposed between the VHTR and the hydrogen production facility, the IHE comprising:

a first IHE portion comprising an evaporation chamber comprising a pool of working fluid directly connected to the VHTR and a first plurality of heat pipes for capturing and transferring heat from the VHTR into the working fluid to vaporize the working fluid;

a second IHE portion elevated relative to the first IHE portion, wherein the second IHE portion comprises a condensation chamber directly connected to the hydrogen production facility and a second plurality of inclined heat pipes for transferring the heat from the vaporized working fluid into the hydrogen production facility by condensing the vaporized working fluid; and a common transport pipe connecting the evaporation chamber of the first IHE portion and the condensation chamber of the second IHE portion.

2. The nuclear power plant according to claim 1, wherein the common transport pipe comprises a thermally insulated coaxial pipe configured to passively transport the vaporized working fluid from the evaporation chamber of the first IHE portion to the condensation chamber of the second IHE portion and to passively transport condensate from the condensation chamber of the second IHE portion to the evaporation chamber of the first IHE portion.

3. The nuclear power plant according to claim 1, wherein the VHTR comprises a coolant chamber, wherein a portion of each heat pipe of the first plurality of heat pipes is configured within the coolant chamber and a remainder of said each heat pipe is configured within the evaporation chamber of the first IHE portion.

4. The nuclear power plant according to claim 3, wherein each of the first plurality of heat pipes comprises a liquid saturated capillary structure configured within the evaporation chamber.

5. The nuclear power plant according to claim 3, wherein an outer surface of each heat pipe of the first plurality of heat pipes within the evaporation chamber comprises longitudinal grooves configured to pump liquid from the pool and spread liquid over a full length of a surface of said each heat pipe by capillary action, thus ensuring continuous wetting of the surface to facilitate evaporation.

6. The nuclear power plant according to claim 5, further comprising a porous wick over the surface, the porous wick configured to provide capillary head in addition to that provided by the longitudinal grooves.

7. The nuclear power plant according to claim 1, wherein the pool of working fluid is configured for replenishment by the condensation chamber via the common transport pipe.

8. The nuclear power plant according to claim 1, wherein the hydrogen production facility comprises a heat exchanger, wherein a portion of each inclined heat pipe of the second plurality of inclined heat pipes is configured within the heat exchanger and a remaining portion of said each inclined heat pipe is configured within the condensation chamber.

9. The nuclear power plant according to claim 1, wherein the condensation chamber comprises a condensate pool, the condensate pool configured by condensation of the vaporized working fluid from the second plurality of inclined heat pipes projecting into the condensation chamber.

10. The nuclear power plant according to claim 8, wherein the second plurality of inclined heat pipes are configured to transfer heat generated by condensation of the vaporized working fluid into a hydrogen production process through the heat exchanger.

11. The nuclear power plant according to claim 1, wherein each of the second plurality of inclined heat pipes comprises a corrugated surface configured to increase a condensation surface area and reduce a thickness of the condensate on the corrugated surface.

12. The nuclear power plant according to claim 1, wherein each of the second plurality of inclined heat pipes inclines at an angle of about 10° to about 20° from a horizontal plane of the evaporation chamber.

* * * * *